US008220500B2

(12) United States Patent
Wang

(10) Patent No.: US 8,220,500 B2
(45) Date of Patent: Jul. 17, 2012

(54) POWER LOOM THAT CAN ADJUST THE SPEED OF THE WEFTS AUTOMATICALLY

(76) Inventor: Shun-Hsing Wang, Long-Jing Township, Taichung County (TW)

( * ) Notice: Subject to any disclaimer, the term of this patent is extended or adjusted under 35 U.S.C. 154(b) by 190 days.

(21) Appl. No.: 12/859,318

(22) Filed: Aug. 19, 2010

(65) Prior Publication Data

US 2012/0042983 A1 Feb. 23, 2012

(51) Int. Cl.
*D03D 47/36* (2006.01)
*D03D 49/50* (2006.01)

(52) U.S. Cl. ..... 139/452; 139/372; 139/371; 139/194; 139/116.1

(58) Field of Classification Search ..... 139/452, 139/372, 371, 194
See application file for complete search history.

(56) References Cited

U.S. PATENT DOCUMENTS 3,825,198 A * 7/1974 Oehninger ..... 242/418.1
4,558,723 A * 12/1985 Tanaka et al. ..... 139/452
4,595,039 A * 6/1986 Tholander ..... 139/435.2
4,702,285 A * 10/1987 Sugita ..... 139/452
4,715,411 A * 12/1987 Van Bogaert et al. ..... 139/452
4,716,943 A * 1/1988 Yoshida et al. ..... 139/452
4,781,224 A * 11/1988 Gotoh et al. ..... 139/435.2
4,932,442 A * 6/1990 Ishido et al. ..... 139/435.2
4,942,909 A * 7/1990 Ghiardo ..... 139/370.2
4,969,489 A * 11/1990 Tanaka et al. ..... 139/450
5,016,680 A * 5/1991 Mitsuya et al. ..... 139/452
5,050,648 A * 9/1991 Pezzoli ..... 139/450
5,127,445 A * 7/1992 Kakehashi ..... 139/452
5,142,751 A * 9/1992 Senba ..... 26/51.3
5,303,746 A * 4/1994 Wahhoud et al. ..... 139/435.2
5,335,700 A * 8/1994 Ishido et al. ..... 139/435.1
5,351,724 A * 10/1994 Zenoni et al. ..... 139/452
5,666,998 A * 9/1997 De Jager et al. ..... 139/194
6,328,081 B1 * 12/2001 Gotti et al. ..... 139/450
6,418,976 B2 * 7/2002 Loehr et al. ..... 139/450
6,810,918 B2 * 11/2004 Birner et al. ..... 139/452
8,086,342 B2 * 12/2011 Gotti et al. ..... 700/140
2001/0022201 A1 * 9/2001 Loehr et al. ..... 139/194
2003/0075230 A1 * 4/2003 Birner et al. ..... 139/256 R
2006/0108018 A1 * 5/2006 Siegl ..... 139/447
2009/0057464 A1 * 3/2009 Gotti et al. ..... 242/365.4

* cited by examiner

*Primary Examiner* — Bobby Muromoto, Jr.
(74) *Attorney, Agent, or Firm* — Alan Kamrath; Kamrath IP Lawfirm, PA

(57) ABSTRACT

A power loom includes a frame, a plurality of warps, a weft spool, a plurality of wefts, and a speed adjustment device. The speed adjustment device includes a support rack, a rotation shaft, a drive motor, a sensor, a press member, and a press rod. Thus, when the output speed of the wefts is gradually reduced to a preset value, the wefts are tensioned and moved upward, and the press member is moved upward to touch the sensor which sends a signal to actuate the drive motor which increases the rotation speed of the rotation shaft and the weft spool to increase the output speed of the wefts largely so that the wefts can be pulled outward from the weft spool quickly to prevent the wefts from being torn or broken due to an excessive pulling force.

10 Claims, 6 Drawing Sheets

POWER LOOM THAT CAN ADJUST THE SPEED OF THE WEFTS AUTOMATICALLY

BACKGROUND OF THE INVENTION

1. Field of the Invention

The present invention relates to a loom and, more particularly, to a power loom for weaving yarns into a cloth, textile or fabric.

2. Description of the Related Art

A conventional power loom comprises a frame, a plurality of warps mounted on the frame, a weft spool located beside the frame, a plurality of wefts wound around the weft spool and drawn into the frame to combine with the warps, a heddle mechanism mounted on the frame to separate and guide the warps, and a shuttle mounted on the frame to clamp the wefts and to draw the wefts to pass through the warps so that the wefts and the warps are weaved together. In operation, the warps are separated by the heddle mechanism so that the warps are separated and arranged in a staggered manner. Then, the wefts on the well spool are drawn into the frame and are clamped by the shuttle. Then, the wefts are drawn by the shuttle to pass through the warps so that the wefts and the warps are weaved together to form a cloth product. In such a manner, when the wefts are pulled outward from the well spool during a period of time, the diameter of the wefts wound around the weft spool is reduced gradually so that the wefts are loosened from the well spool, and the output speed of the wefts is gradually smaller than the weaving speed of the power loom. Thus, the wefts are stretched gradually by the pulling force of the power loom. However, when the wefts are tensioned, the wefts are easily torn or broken due to a larger pulling force, thereby stopping operation of the power loom, and thereby decreasing the productivity of the cloth product. In addition, the wefts are directly drawn by the shuttle and are not trimmed so that the wefts are not disposed at a smooth state when entering the frame and are not combined with the warps smoothly, thereby decreasing the quality of the cloth product.

BRIEF SUMMARY OF THE INVENTION

In accordance with the present invention, there is provided a power loom, comprising a frame, a plurality of warps mounted on the frame, a weft spool located beside the frame, a plurality of wefts wound around the weft spool and drawn into the frame to combine with the warps, and a speed adjustment device connected with the weft spool to adjust a rotation speed of the weft spool so as to adjust an output speed of the wefts. The speed adjustment device includes a support rack located beside the frame to support the weft spool, a rotation shaft rotatably mounted on the support rack and extended through the weft spool to rotate the weft spool, a drive motor mounted on the support rack and connected with the rotation shaft to rotate the rotation shaft, a sensor mounted on the support rack and electrically connected with the drive motor, a press member pivotally connected with the support rack and movable to pass through the sensor to activate the sensor, and a press rod mounted on the press member and pressing the wefts to tension the wefts.

The power loom further comprises a warp delivery device located beside the frame to draw the warps from a warp rack to the frame.

The power loom further comprises a pair of weft rollers disposed between the speed adjustment device and the frame to guide movement of the wefts, and the wefts are extended and pressed between the weft rollers.

The power loom further comprises a plurality of direction turning members disposed between the weft rollers and the frame to turn and trim the wefts. The direction turning members are directed in different directions. Thus, after the wefts are turned and trimmed by the direction turning members, the wefts are drawn to the frame to combine with the warps. In such a manner, the friction produced during movement of the wefts is reduced by rotation of the direction turning members so that the wefts are drawn smoothly.

The press member of the speed adjustment device is preferably a rectangular hollow bracket. The press member of the speed adjustment device has a first end connected with the press rod, a mediate portion pivotally connected with the support rack and a second end provided with a weight member to balance the press rod.

The power loom further comprises a pair of press rolls to press a combination of the warps and the wefts, and a winding spool located beside the press rolls to wind the combination of the warps and the wefts. The combination of the warps and the wefts are pressed between the press rolls.

The power loom further comprises a warp output machine to draw the warps from a warp rack to the frame, and a winding machine to wind the combination of the warps and the wefts.

The primary objective of the present invention is to provide a power loom that can adjust the speed of the wefts automatically.

According to the primary advantage of the present invention, when the output speed of the wefts is gradually reduced to a preset value, the wefts are tensioned and moved upward, and the press member is moved upward to touch and activate the sensor which sends a signal to actuate the drive motor which increases the rotation speed of the rotation shaft and the weft spool to increase the output speed of the wefts largely so that the wefts can be pulled outward from the weft spool quickly so as to prevent the wefts from being torn or broken due to an excessive pulling force.

According to another advantage of the present invention, the wefts are pressed downward by the press rod and the press member so that the wefts have a determined tension.

According to a further advantage of the present invention, the speed adjustment device can adjust the output speed of the wefts automatically so that the wefts will not be torn or broken during operation so as to increase the productivity of the power loom.

According to a further advantage of the present invention, the wefts are turned and trimmed by the direction turning members before the wefts enters the frame so that the wefts are drawn into the frame smoothly to enhance the quality of the cloth product.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
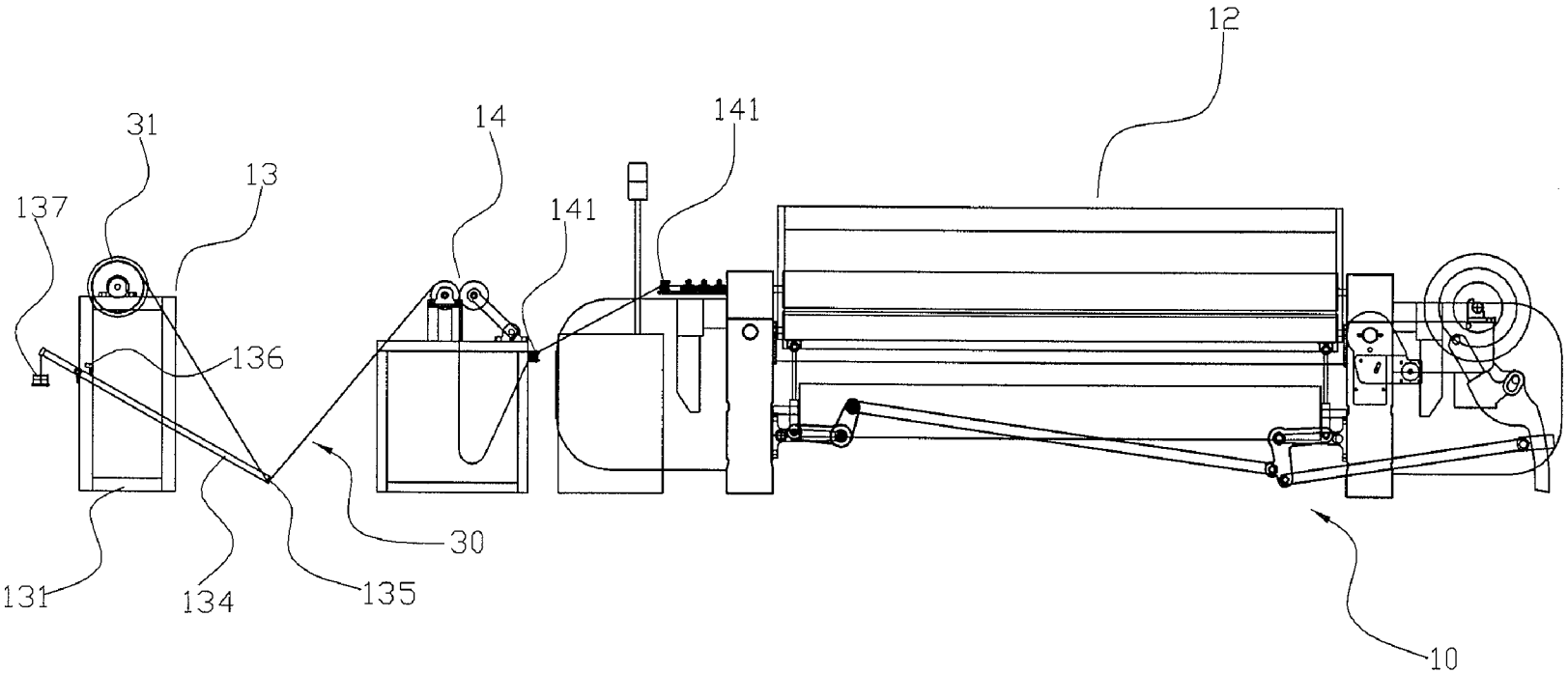
FIG. 1 is a front view of a power loom in accordance with the preferred embodiment of the present invention.
Figure 2:
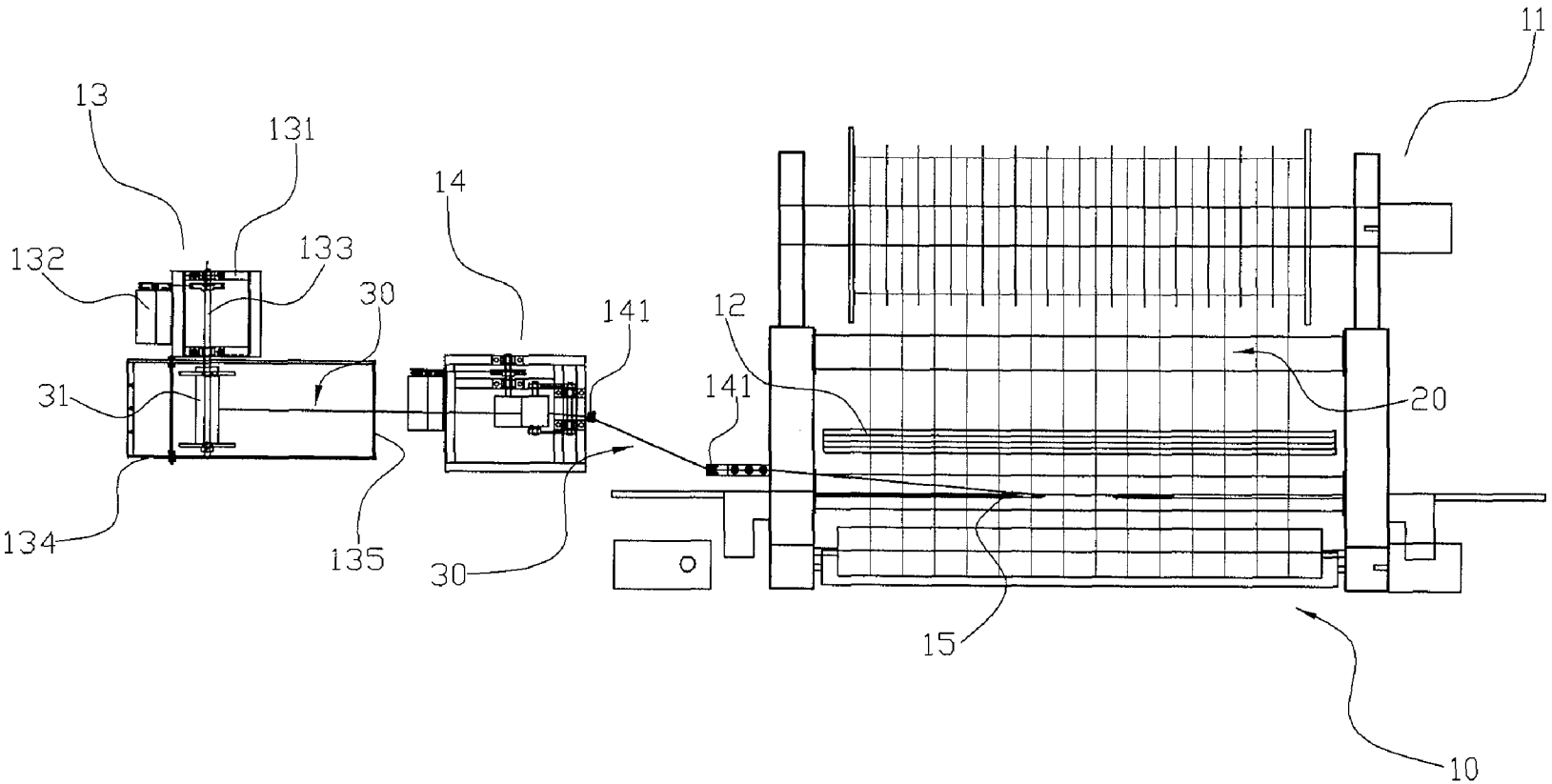
FIG. 2 is a top view of the power loom as shown in FIG. 1.
Figure 3:
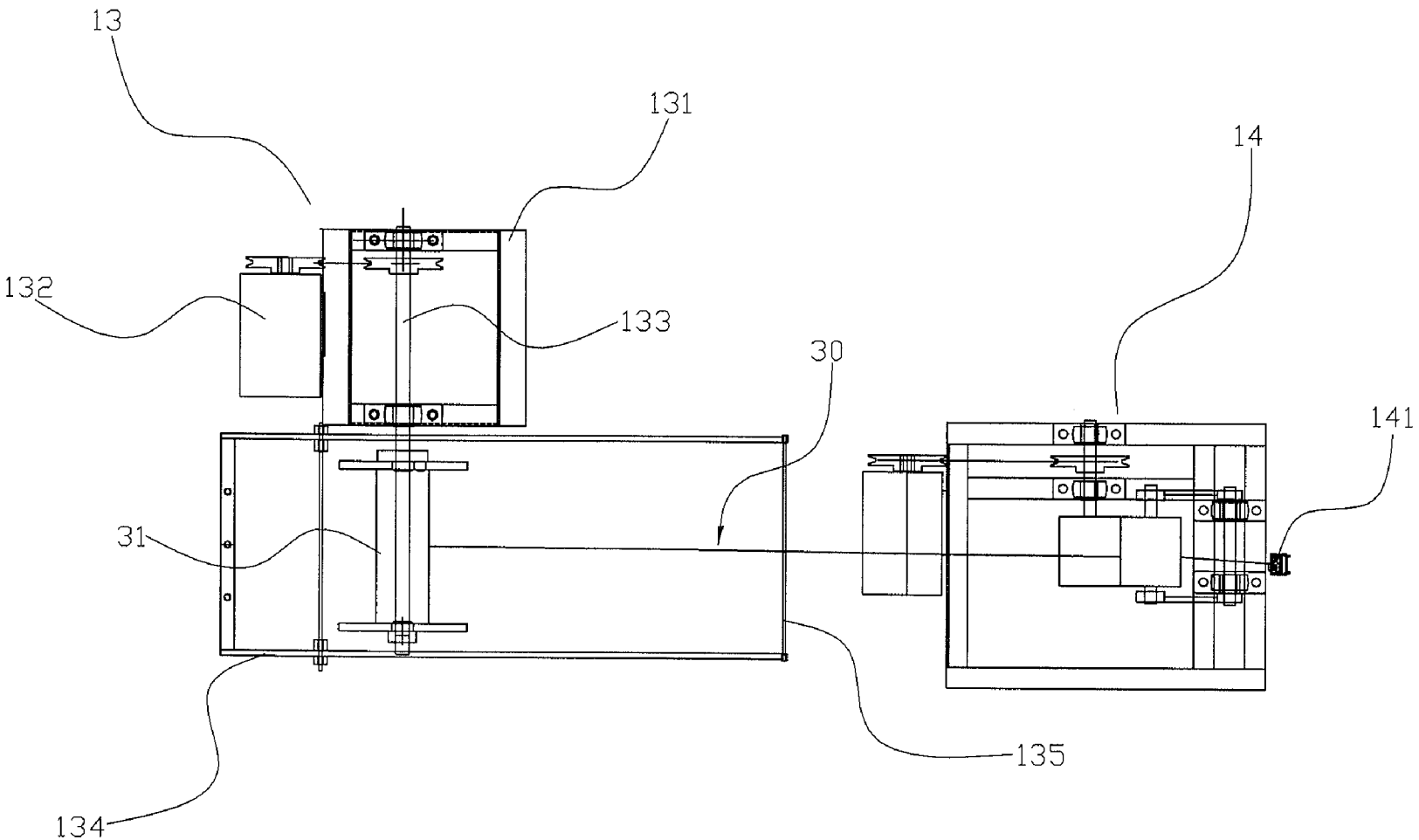
FIG. 3 is a locally enlarged view of the power loom as shown in FIG. 2.

Referring to the drawings and initially to FIGS. 1-3, a power loom in accordance with the preferred embodiment of the present invention comprises a frame 10, a plurality of warps 20 mounted on the frame 10, a weft spool 31 located beside the frame 10, a plurality of wefts 30 wound around the weft spool 31 and drawn into the frame 10 to combine with the warps 20, a speed adjustment device 13 connected with the weft spool 31 to adjust a rotation speed of the weft spool 31 so as to adjust an output speed of the wefts 30, a heddle mechanism 12 mounted on the frame 10 to separate and guide the warps 20, and a shuttle 15 mounted on the frame 10 to clamp the wefts 30 and to draw the wefts 30 to pass through the warps 20 so that the wefts 30 and the warps 20 are weaved together.

The speed adjustment device 13 includes a support rack 131 located beside the frame 10 to support the weft spool 31, a rotation shaft 133 rotatably mounted on the support rack 131 and extended through the weft spool 31 to rotate the weft spool 31, a drive motor 132 mounted on the support rack 131 and connected with the rotation shaft 133 to rotate the rotation shaft 133, a sensor 136 mounted on the support rack 131 and electrically connected with the drive motor 132, a press member 134 pivotally connected with the support rack 131 and movable to pass through the sensor 136 to activate the sensor 136, and a press rod 135 mounted on the press member 134 and pressing the wefts 30 to tension the wefts 30.

The rotation shaft 133 of the speed adjustment device 13 has a first end rotatably mounted on the support rack 131 and a second end protruding outwardly from the support rack 131, and the weft spool 31 is secured on the second end of the rotation shaft 133. The press member 134 of the speed adjustment device 13 protrudes outwardly from the support rack 131 and is disposed under the sensor 136. The press member 134 of the speed adjustment device 13 has a first end connected with the press rod 135, a mediate portion pivotally connected with the support rack 131 and a second end provided with a weight member 137 to balance the press rod 135. Preferably, the press member 134 of the speed adjustment device 13 is a rectangular hollow bracket. The press rod 135 of the speed adjustment device 13 protrudes outwardly from the support rack 131 and is disposed above the wefts 30. Preferably, the sensor 136 of the speed adjustment device 13 is a contact switch.

In the preferred embodiment of the present invention, the power loom further comprises a warp delivery device 11 located beside the frame 10 to draw the warps 20 from a warp rack (not shown) to the frame 10. The warp delivery device 11 includes a pair of warp rollers (not shown) to clamp and guide the warps 20, and a servomotor (not shown) connected with the warp rollers to rotate the warp rollers so as to deliver the warps 20.

In the preferred embodiment of the present invention, the power loom further comprises a pair of weft rollers 14 disposed between the speed adjustment device 13 and the frame 10 to guide movement of the wefts 30, and the wefts 30 are extended and pressed between the weft rollers 14.

In the preferred embodiment of the present invention, the power loom further comprises a plurality of direction turning members 141 disposed between the weft rollers 14 and the frame 10 to turn and trim the wefts 30. The direction turning members 141 are directed in different directions. Thus, after the wefts 30 are turned and trimmed by the direction turning members 141, the wefts 30 are drawn to the frame 10 to combine with the warps 20. In such a manner, the friction produced during movement of the wefts 30 is reduced by rotation of the direction turning members 141 so that the wefts 30 are drawn smoothly.

In operation, again referring to FIGS. 1-3, the warp delivery device 11 draws the warps 20 from the warp rack to the frame 10. Then, the warps 20 are separated by the heddle mechanism 12 so that the warps 20 are separated and arranged in a staggered manner. Then, the wefts 30 on the weft spool 31 in turn pass through the weft rollers 14 and the direction turning members 141 and are clamped by the shuttle 15. At this time, the wefts 30 are turned and trimmed by the direction turning members 141. Then, the wefts 30 are drawn by the shuttle 15 to pass through the warps 20 so that the wefts 30 and the warps 20 are weaved together. In such a manner, the wefts 30 are pressed downward by the press rod 135 and the press member 134 of the speed adjustment device 13 so that the wefts 30 are tensioned tightly at a normal state. In addition, the friction produced during movement of the wefts 30 is reduced by rotation of the direction turning members 141 so that the wefts 30 are drawn smoothly.

Figure 4:
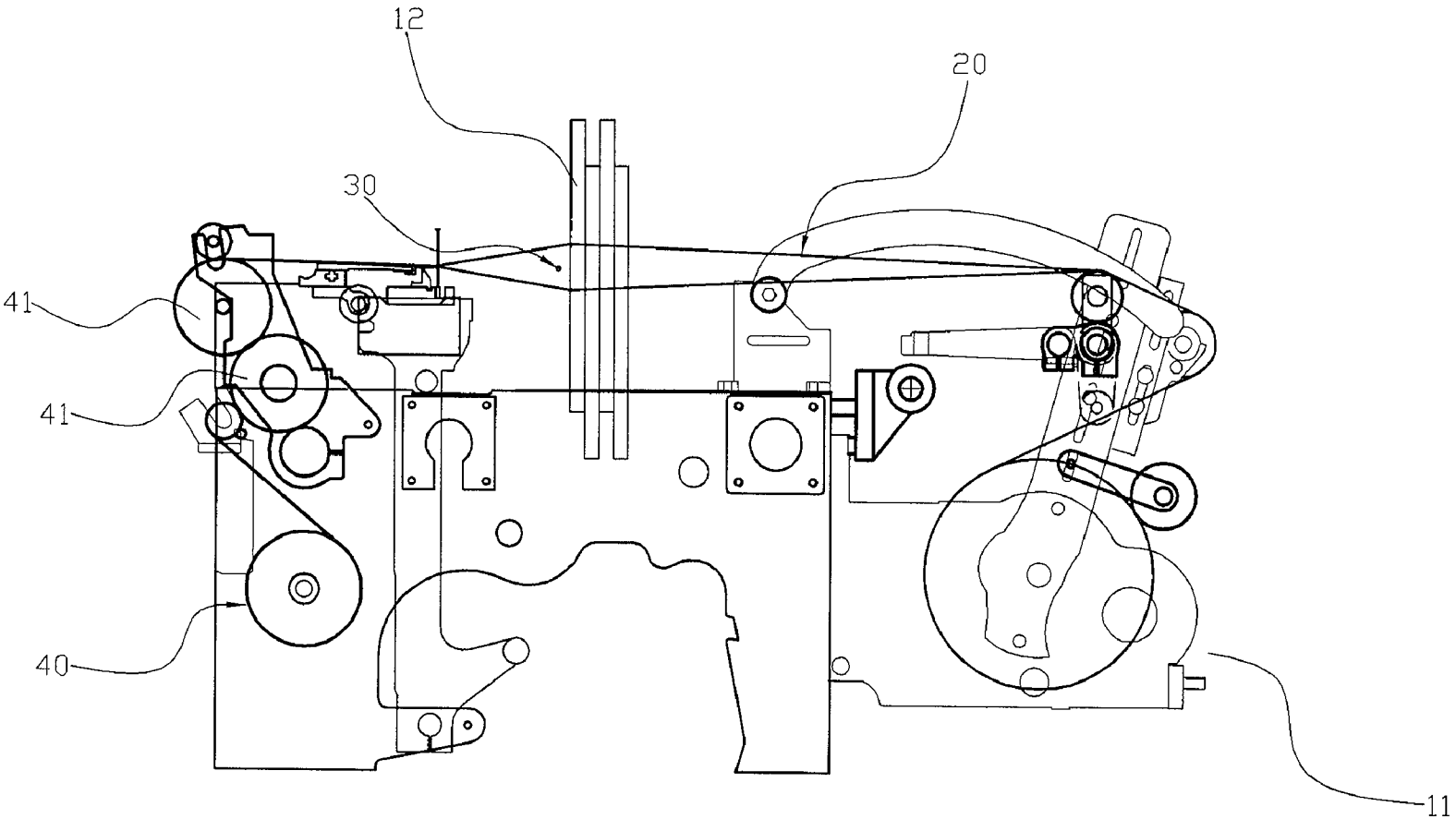
FIG. 4 is a schematic operational view of the power loom as shown in FIG. 1.

In adjustment, referring to FIG. 4 with reference to FIGS. 1-3, when the wefts 30 are pulled outward from the weft spool 31 during a period of time, the diameter of the wefts 30 wound around the weft spool 31 is reduced gradually so that the wefts 30 are loosened from the weft spool 31, and the output speed of the wefts 30 is gradually smaller than the weaving speed of the power loom. Thus, the wefts 30 are stretched gradually by the pulling force of the power loom. When the wefts 30 are tensioned, the wefts 30 are moved upward to lift the press rod 135 which pivots and lifts the press member 134 so that the press member 134 is moved upward to touch and activate the sensor 136. In such a manner, the sensor 136 sends a signal to actuate the drive motor 132 which increases the rotation speed of the rotation shaft 133 which increases the rotation speed of the weft spool 31 to increase the output speed of the wefts 30 largely so that the wefts 30 can be delivered to the shuttle 15 quickly and exactly to prevent the wefts 30 from being torn or broken due to an excessive pulling force. At this time, the wefts 30 are pressed downward by the press rod 135 and the press member 134 of the speed adjustment device 13 so that the wefts 30 have a determined tension. In addition, the weight member 137 can balance the press rod 135 to facilitate upward movement of the press member 134.

Figure 5:
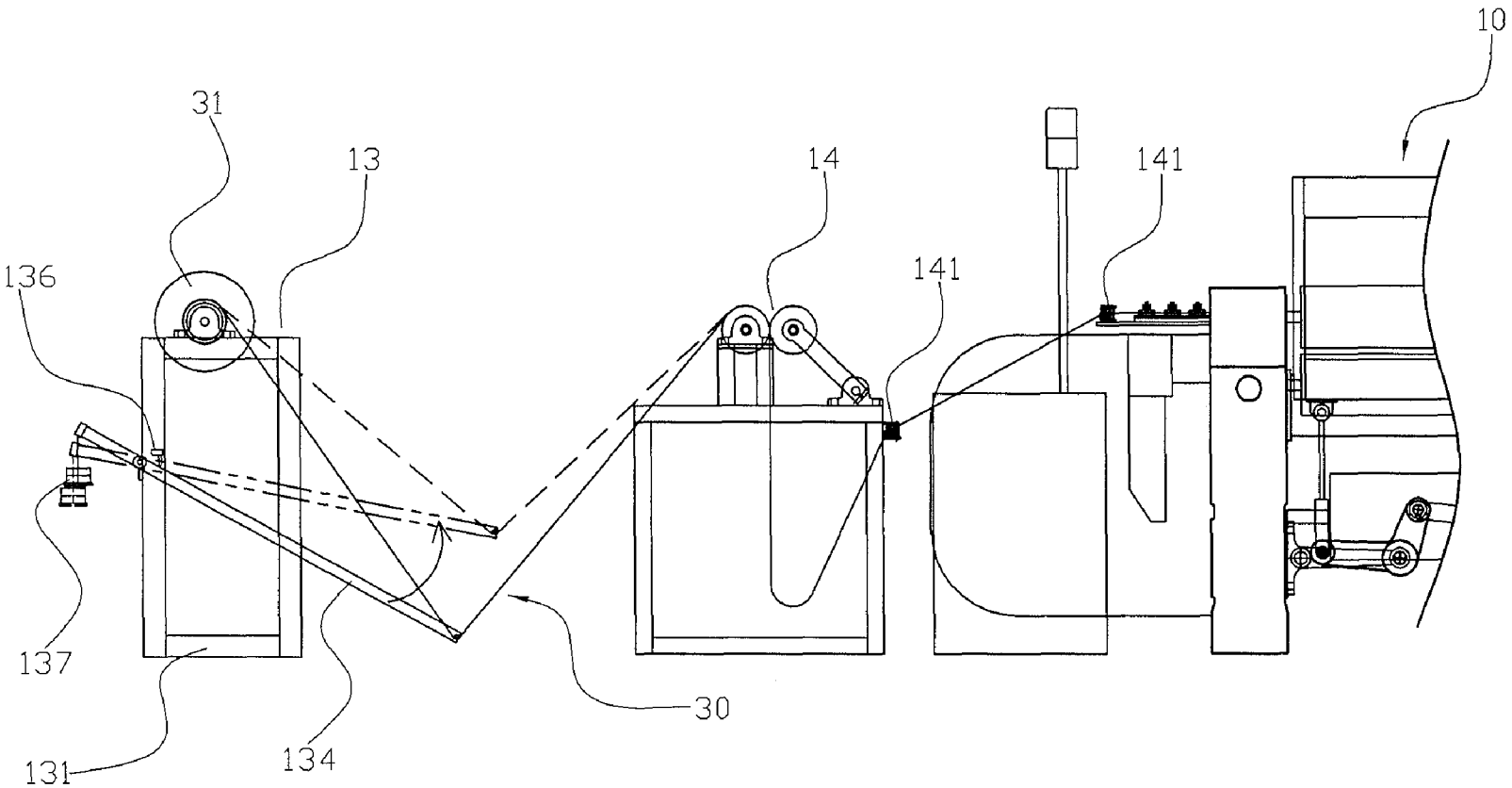
FIG. 5 is a side view of a power loom in accordance with another preferred embodiment of the present invention.

Referring to FIG. 5, the power loom further comprises a pair of press rolls 41 to press a combination of the warps 20 and the wefts 30, and a winding spool 40 located beside the press rolls 41 to wind the combination of the warps 20 and the wefts 30. The combination of the warps 20 and the wefts 30 are pressed between the press rolls 41. Thus, the combination of the warps 20 and the wefts 30 is pressed and trimmed to form a smooth cloth, and the cloth is wound around the winding spool 40.

Figure 6:
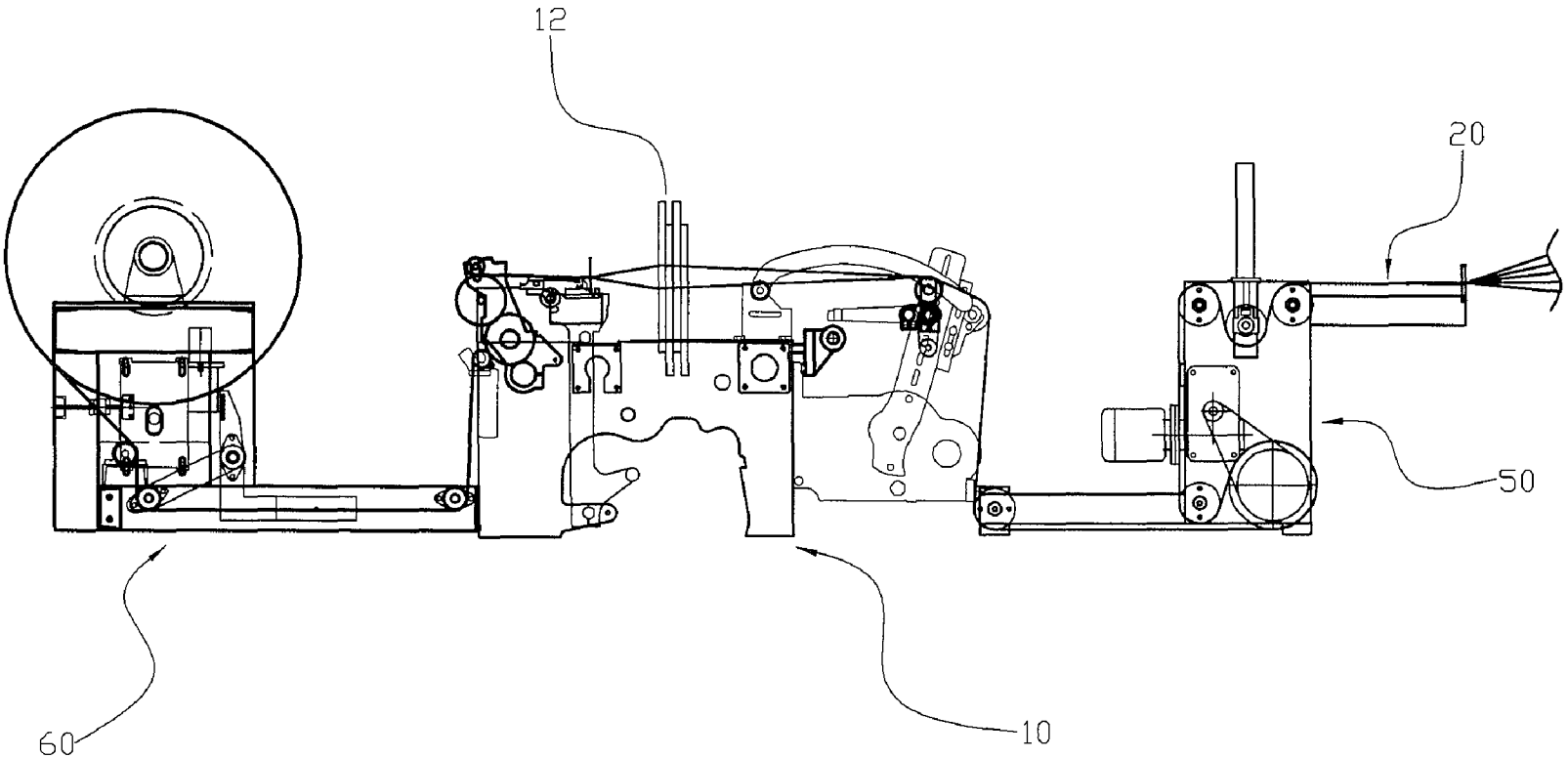
FIG. 6 is a side view of a power loom in accordance with another preferred embodiment of the present invention.

Referring to FIG. 6, the power loom further comprises a warp output machine 50 to draw the warps 20 from a warp rack (not shown) to the frame 10, and a winding machine 60 to wind the combination of the warps 20 and the wefts 30.

Accordingly, when the output speed of the wefts 30 is gradually reduced to a preset value, the wefts 30 are tensioned and moved upward, and the press member 134 is moved upward to touch and activate the sensor 136 which sends a signal to actuate the drive motor 132 which increases the rotation speed of the rotation shaft 133 and the weft spool 31 to increase the output speed of the wefts 30 largely so that the wefts 30 can be pulled outward from the weft spool 31 quickly so as to prevent the wefts 30 from being torn or broken due to an excessive pulling force. In addition, the wefts 30 are pressed downward by the press rod 135 and the press member 134 so that the wefts 30 have a determined tension. Further, the speed adjustment device 13 can adjust the output speed of the wefts 30 automatically so that the wefts 30 will not be torn or broken during operation so as to increase the productivity of the power loom. Further, the wefts 30 are turned and trimmed by the direction turning members 141 before the wefts 30 enters the frame 10 so that the wefts 30 are drawn into the frame 10 smoothly to enhance the quality of the cloth product.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A power loom, comprising:

a frame;

a plurality of warps mounted on the frame;

a weft spool located beside the frame;

a plurality of wefts wound around the weft spool and drawn into the frame to combine with the warps; and a speed adjustment device connected with the weft spool to adjust a rotation speed of the weft spool so as to adjust an output speed of the wefts;

wherein the speed adjustment device includes:

a support rack located beside the frame to support the weft spool;

a rotation shaft rotatably mounted on the support rack and extended through the weft spool to rotate the weft spool;

a drive motor mounted on the support rack and connected with the rotation shaft to rotate the rotation shaft;

a sensor mounted on the support rack and electrically connected with the drive motor;

a press member pivotally connected with the support rack and movable to pass through the sensor to activate the sensor; and a press rod mounted on the press member and pressing the wefts to tension the wefts.

2. The power loom of claim 1, wherein the power loom further comprises a warp delivery device located beside the frame to draw the warps from a warp rack to the frame.

3. The power loom of claim 1, wherein the power loom further comprises a pair of weft rollers disposed between the speed adjustment device and the frame to guide movement of the wefts, and the wefts are extended and pressed between the weft rollers.

4. The power loom of claim 3, wherein the power loom further comprises a plurality of direction turning members disposed between the weft rollers and the frame to turn and trim the wefts;

the direction turning members are directed in different directions;

after the wefts are turned and trimmed by the direction turning members, the wefts are drawn to the frame to combine with the warps;

a friction produced during movement of the wefts is reduced by rotation of the direction turning members so that the wefts are drawn smoothly.

5. The power loom of claim 1, wherein the press member of the speed adjustment device is a rectangular hollow bracket.

6. The power loom of claim 1, wherein the press member of the speed adjustment device has a first end connected with the press rod, a mediate portion pivotally connected with the support rack and a second end provided with a weight member to balance the press rod.

7. The power loom of claim 1, wherein the power loom further comprises:

a pair of press rolls to press a combination of the warps and the wefts; and a winding spool located beside the press rolls to wind the combination of the warps and the wefts;

the combination of the warps and the wefts are pressed between the press rolls.

8. The power loom of claim 1, wherein the power loom further comprises:

a warp output machine to draw the warps from a warp rack to the frame; and a winding machine to wind the combination of the warps and the wefts.

9. The power loom of claim 1, wherein the rotation shaft of the speed adjustment device has a first end rotatably mounted on the support rack and a second end protruding outwardly from the support rack;

the weft spool is secured on the second end of the rotation shaft.

10. The power loom of claim 1, wherein the press member of the speed adjustment device protrudes outwardly from the support rack and is disposed under the sensor;

the press rod of the speed adjustment device protrudes outwardly from the support rack and is disposed above the wefts.

* * * * *